US009129577B2

(12) United States Patent
Park et al.

(10) Patent No.: US 9,129,577 B2
(45) Date of Patent: Sep. 8, 2015

(54) LAYOUT OF A GROUP OF GATE DRIVING STAGES WHEREIN TWO STAGES ARE ADJACENT IN THE COLUMN DIRECTION AND A THIRD STAGE IS ADJACENT TO BOTH SAID STAGES IN THE ROW DIRECTION

(75) Inventors: Kyung-ho Park, Asan-si (KR); Ji-Sun Kim, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 391 days.

(21) Appl. No.: 13/402,262

(22) Filed: Feb. 22, 2012

(65) Prior Publication Data

US 2013/0106920 A1 May 2, 2013

(30) Foreign Application Priority Data

Oct. 26, 2011 (KR) ..... 10-2011-0110136

(51) Int. Cl.
*G09G 3/36* (2006.01)

(52) U.S. Cl.
CPC ..... *G09G 3/3677* (2013.01); *G09G 2310/0281* (2013.01)

(58) Field of Classification Search
CPC ..... G09G 2310/0286; G09G 3/3674–3/3677; G09G 3/3266; G09G 2310/0267; G09G 2300/0408; G09G 2310/0243; G09G 2310/0281; G02F 1/13452; G02F 1/13454; G02F 17/5068; G02F 17/5081; H01L 27/1214; H01L 27/0207
USPC ..... 345/87–104, 204–215, 690–699; 349/149–152
See application file for complete search history.

(56) References Cited

U.S. PATENT DOCUMENTS

| | | | | |
|---|---|---|---|---|
| 3,819,921 | A * | 6/1974 | Kilby et al. | 708/190 |
| 2005/0200591 | A1* | 9/2005 | Satoh et al. | 345/103 |
| 2007/0040792 | A1* | 2/2007 | Kwag et al. | 345/100 |
| 2007/0085811 | A1* | 4/2007 | Lee | 345/100 |
| 2007/0182688 | A1* | 8/2007 | Jang | 345/98 |
| 2010/0085294 | A1* | 4/2010 | Otose | 345/100 |
| 2010/0103153 | A1* | 4/2010 | Satoh et al. | 345/208 |
| 2011/0069044 | A1* | 3/2011 | Lee et al. | 345/204 |
| 2011/0148830 | A1* | 6/2011 | Hsu et al. | 345/205 |
| 2012/0050234 | A1* | 3/2012 | Jang et al. | 345/204 |
| 2012/0120035 | A1* | 5/2012 | Yang et al. | 345/205 |
| 2012/0293762 | A1* | 11/2012 | Shin et al. | 349/139 |
| 2013/0050157 | A1* | 2/2013 | Baek et al. | 345/204 |

FOREIGN PATENT DOCUMENTS

| | | | |
|---|---|---|---|
| JP | 2010-218673 | A | 9/2010 |
| KR | 10-0560455 | B1 | 3/2006 |
| KR | 1020080049445 | A | 6/2008 |

* cited by examiner

*Primary Examiner* — Chanh Nguyen
*Assistant Examiner* — Navin Lingaraju
(74) *Attorney, Agent, or Firm* — Cantor Colburn LLP

(57) ABSTRACT

A display apparatus includes a display panel including a plurality of pixel columns to display an image, wherein each of the pixel columns includes a plurality of pixels arranged in a first direction and sequentially turned-on in the first direction; a gate driver disposed on the display panel and including a plurality of stages connected to the pixels to sequentially apply a gate signal to the pixels, where at least two stages of the stages are disposed adjacent to each other in a second direction different from the first direction; and a data driver which applies a data voltage to the pixels.

12 Claims, 10 Drawing Sheets

LAYOUT OF A GROUP OF GATE DRIVING STAGES WHEREIN TWO STAGES ARE ADJACENT IN THE COLUMN DIRECTION AND A THIRD STAGE IS ADJACENT TO BOTH SAID STAGES IN THE ROW DIRECTION

This application claims priority upon Korean Patent Application No. 10-2011-0110136, filed on Oct. 26, 2011, and all the benefits accruing therefrom under 35 U.S.C. §119, the content of which in its entirety is herein incorporated by reference.

BACKGROUND OF THE INVENTION (1) Field of the Invention

Exemplary embodiments of the invention relate to a display apparatus. More particularly, exemplary embodiments of the invention relate to a display apparatus, in which an area of a black matrix thereof is effectively utilized.

(2) Description of the Related Art

In general, a liquid crystal display includes a liquid crystal display panel. The liquid crystal display panel typically includes a lower substrate, an upper substrate facing the lower substrate, and a liquid crystal layer disposed between the lower substrate and the upper substrate to display an image.

The liquid crystal display panel includes a plurality of gate lines, a plurality of data lines, and a plurality of pixels connected to the gate lines and the data lines. The liquid crystal display panel is connected to a gate driver that sequentially applies a gate signal to the gate lines and a data driver that applies a data signal to the data lines.

In recent, the liquid crystal display employs a structure in which the gate driver is directly formed in an area of a black matrix through a thin film process. However, in the liquid crystal display, the gate driver may not be appropriately formed when the area for the black matrix is too small.

BRIEF SUMMARY OF THE INVENTION

Exemplary embodiments of the invention provide a display apparatus including a gate driver capable of effectively utilizing an area for a black matrix.

According to an exemplary embodiment, a display apparatus includes a display panel including a plurality of pixel columns to display an image, where each of the pixel columns includes a plurality of pixels arranged in a first direction and sequentially turned-on in the first direction; a gate driver disposed on the display panel and including a plurality of stages connected to the pixels to sequentially apply a gate signal to the pixels, where at least two stages of the stages are disposed adjacent to each other in a second direction different from the first direction; and a data driver which applies a data voltage to the pixels.

According to exemplary embodiments of the invention, at least two stages of the stages included in the gate driver are disposed adjacent to each other in the second direction different from the first direction in which the pixels are sequentially driven, such that an area utilization efficiency of the stages in the gate driver on the display panel may be improved when the gate driver is provided on the display panel, and a width of a black matrix area of the display panel is thereby substantially reduced.

BRIEF DESCRIPTION OF THE DRAWINGS

The above and other objects and features of the invention will become more apparent by describing in further detail exemplary embodiments thereof with reference to the accompanying drawings, in which.

DETAILED DESCRIPTION OF THE INVENTION

Figure 1:
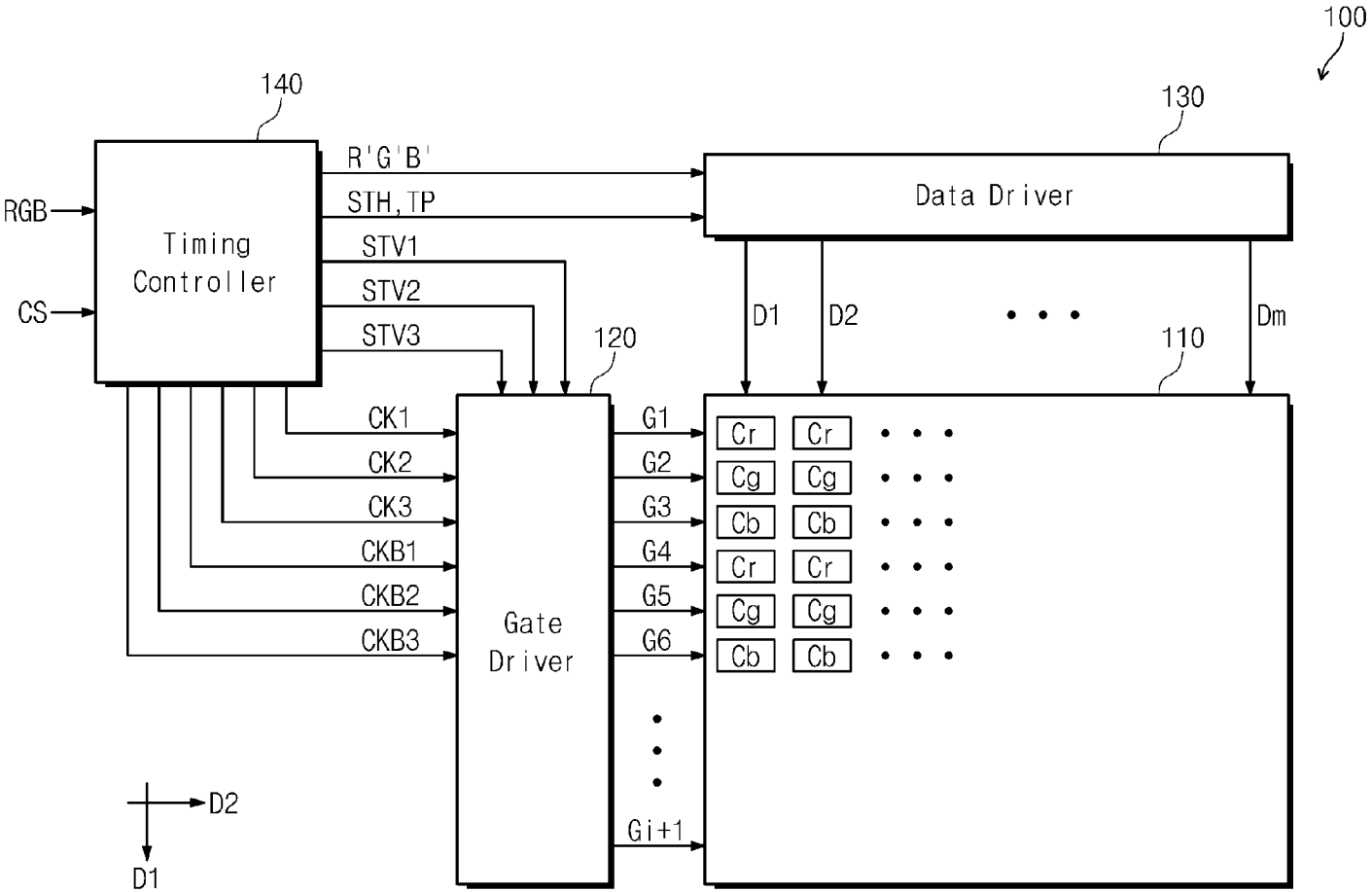
FIG. 1 is a block diagram showing an exemplary embodiment of a display apparatus according to the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a block diagram showing an exemplary embodiment of a display apparatus according to the invention.

Referring to FIG. 1, a display apparatus 100 includes a display panel 110, a gate driver 120, a data driver 130 and a timing controller 140.

The display panel 110 includes a plurality of pixel columns arranged thereon. Each of the pixel columns includes a plurality of pixels arranged in a column direction (hereinafter, first direction D1). In such an embodiment, the pixels included in each pixel column may be sequentially driven in the first direction D1. In an exemplary embodiment, the pixel columns are arranged along a row direction (hereinafter, second direction D2). The pixels arranged in the same pixel column may be substantially simultaneously driven.

The display panel 110 further includes red, green and blue color pixels Cr, Cg and Cb. The red, green and blue color pixels Cr, Cg and Cb are sequentially arranged in the first direction D1, and the arrangement of the red, green and blue color pixels Cr, Cg and Cb is repeated in the first direction D1. In one exemplary embodiment, for example, the color pixels arranged in a same row represent a same color, e.g., red, green and blue colors, but not being limited thereto. In an alternative exemplary embodiment, the color pixels included in the display panel 110 may display various colors, such as white, yellow, cyan and magenta, for example.

The display panel 110 includes two opposing substrates, e.g., first and second substrates, and the pixels are arranged on one of the two opposing substrates, e.g., the first substrate. In such an embodiment, the pixels are disposed on the first substrate or on the second substrate.

Each of the pixels is connected to the gate driver 120 and the data driver 130. Accordingly, each of the pixels is turned on in response to a gate signal provided from the gate driver 120 and displays an image corresponding to a data voltage provided from the data driver 130.

The timing controller 140 receives a plurality of image signals RGB and a plurality of control signals CS from an external device (not shown). The timing controller 140 converts a data format of the image signals RGB into another data format corresponding to an interface between the data driver 130 and the timing controller 140 and applies converted image signals R'G'B' to the data driver 130. In an exemplary embodiment, the timing controller 140 applies data control signals, such as an output start signal TP and a horizontal start signal STH, for example, to the data driver 130 and applies gate control signals, such as vertical start signals (e.g., a first vertical start signal STV1, a second vertical start signal STV2 and a third vertical start signal STV3), vertical clock signals (e.g., a first clock CK1, a second clock CK2 and a third clock CK3) and vertical clock bar signals (e.g., a first clock bar CKB1, a second clock bar CKB2 and a third clock bar CKB3), to the gate driver 120.

The gate driver 120 sequentially outputs gate signals (e.g., first to (i+1)-th gate signals G1 to Gi+1) in response to the gate control signals STV1, STV2, STV3, CK1, CK2, CK3, CKB1, CKB2 and CKB3 provided from the timing controller 140. In such an embodiment, the pixels may be sequentially scanned by the gate signals G1 to Gi+1 on a row-by-row basis.

The data driver 130 converts the converted image signals R'G'B' into data voltages, e.g., first to m-th data voltages D1 to Dm, in response to the data control signals TP and STH provided from the timing controller 140 and outputs the data voltages D1 to Dm. The data voltages D1 to Dm output from the data driver 130 are applied to the display panel 110.

In an exemplary embodiment, each of the pixels is turned on in response to a corresponding gate signal of the gate signals, e.g., first to (i+1)-th gate signals G1 to Gi+1, and the turned-on pixel receives a corresponding data voltage of the data voltages D1 to Dm from the data driver 130 to display the image corresponding to a predetermined gray scale.

Figure 2:
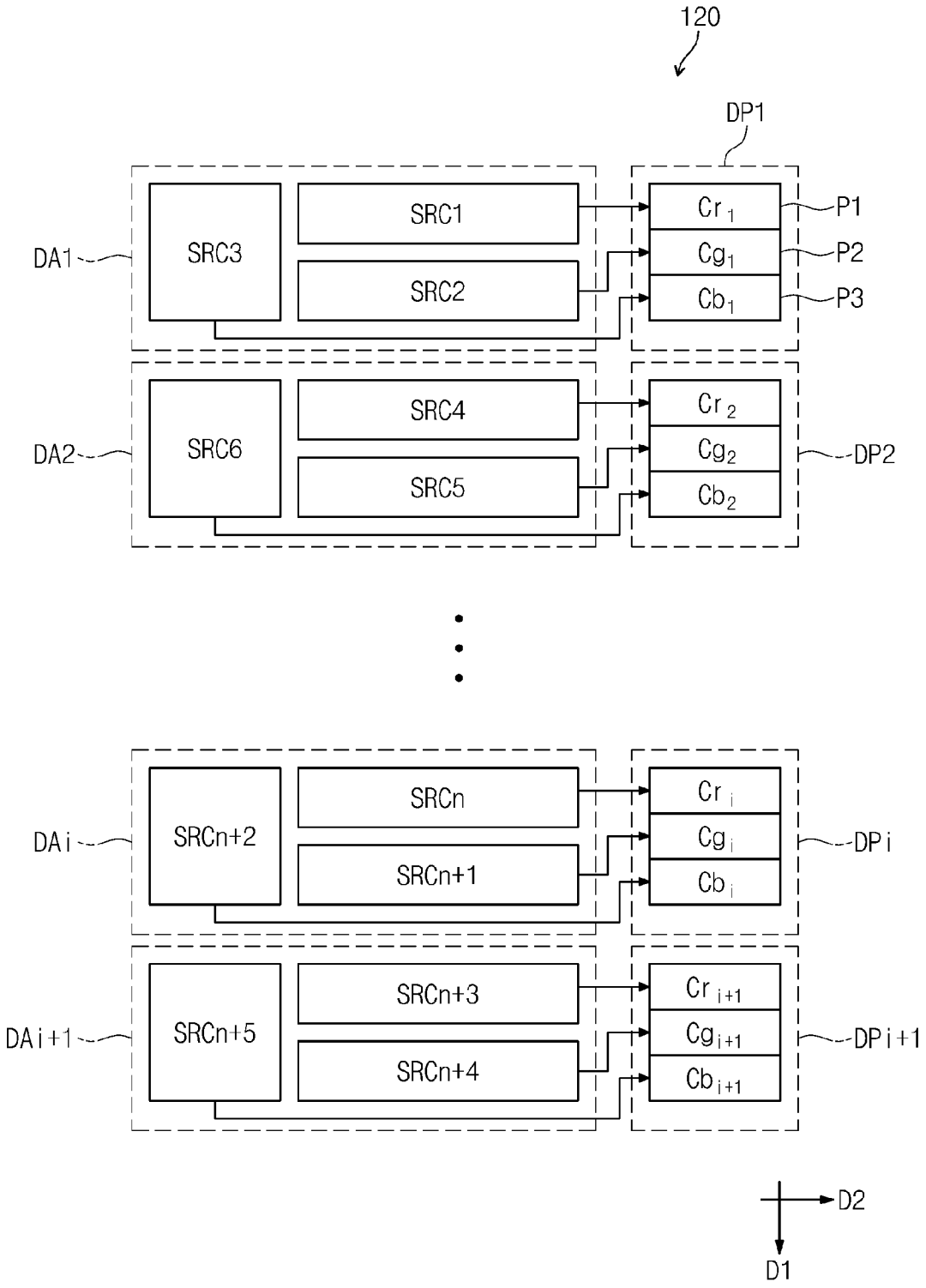
FIG. 2 is a block diagram showing an exemplary embodiment of a gate driver shown in FIG. 1.
Figure 3:
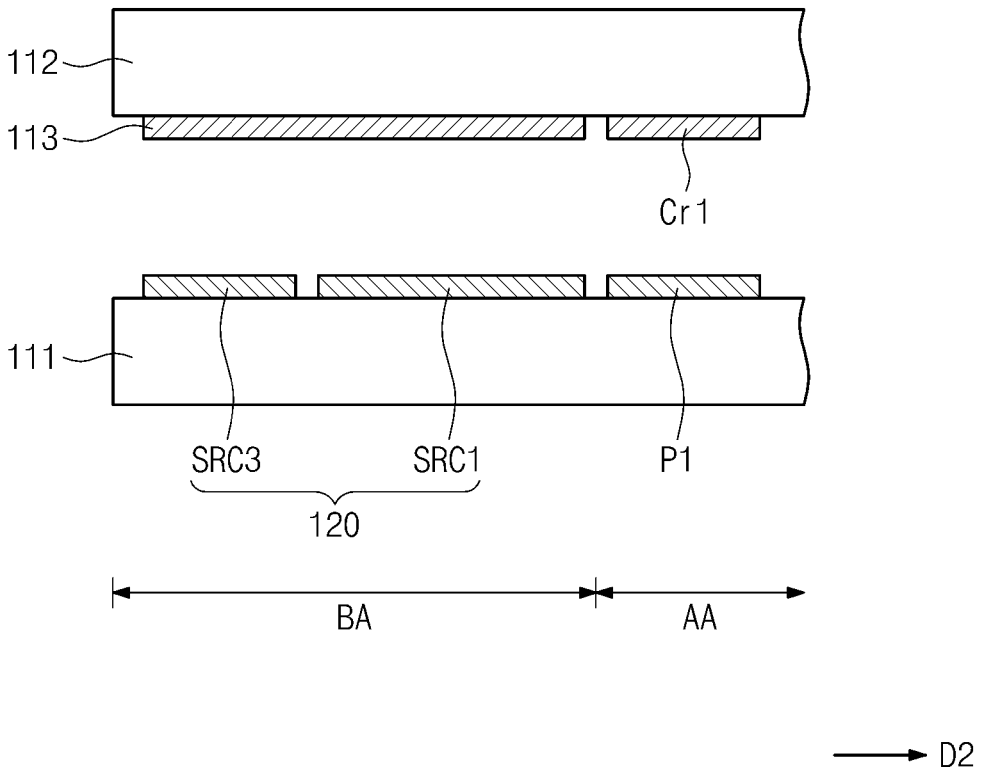
FIG. 3 is a cross-sectional view taken along line I-I' of the gate driver shown in FIG. 2 on an exemplary embodiment of a display panel.

FIG. 2 is a block diagram showing an exemplary embodiment of the gate driver shown in FIG. 1, and FIG. 3 is a cross-sectional view taken along line I-I' of the gate driver shown in FIG. 2 on a display panel.

Referring to FIG. 2, the gate driver 120 includes a plurality of stages, e.g., first to (n+5)-th stages SRC1 to SRCn+5. In an exemplary embodiment, the stages SRC1 to SRCn+5 are disposed on the display panel 110 and respectively connected to the pixels to sequentially apply the gate signals G1 to Gi+1.

As shown in FIG. 3, the display panel 110 includes an active area AA, in which the pixels, e.g., a first pixel P1, are disposed to display the image, and a black matrix area BA, in which a black matrix 113 is disposed. The black matrix area BA is disposed adjacent to the active area AA. The display panel 110 includes a first substrate 111 and a second substrate 112, opposite to, e.g., facing, each other, and the pixels P1 and the gate driver 120 are disposed on the first substrate 111. The gate driver 120 is disposed on the first substrate 111 corresponding to the black matrix area BA and electrically connected to the pixels P1. The color pixels, e.g., a first red color pixel Cr1, are disposed on the second substrate 112 corresponding to the pixels P1, respectively, and the black matrix 113 is disposed in the black matrix area BA to effectively prevent or substantially reduce a light leakage.

Referring again to FIG. 2, the gate driver 120 is divided into i+1 driving areas, e.g., first to (i+1)-th driving area DA1 to DAi+1 ("i" is an odd-number greater than or equal to 1). The i+1 driving areas DA1 to DAi+1 may be sequentially arranged in the first direction D1. In one exemplary embodiment, for example, each of the i+1 driving areas DA1 to DAi+1 includes three stages. For the convenience of description, the three stages arranged in a first driving area DA1 of the i+1 driving areas DA1 to DAi+1 are referred to as a first stage SRC1, a second stage SRC2 and a third stage SRC3, and the three stages arranged in a second driving area DA2 are referred to as a fourth stage SRC4, a fifth stage SRC5 and a sixth stage SRC6.

At least two stages of the three stages included in each of the driving areas are disposed adjacent to each other in the second direction D2 substantially perpendicular to the first direction D1. In an exemplary embodiment, as shown in FIG. 2, the first and second stages SRC1 and SRC2 are disposed adjacent to each other in the first direction D1 and the third stage SRC3 is positioned at a left side of the first and second stages SRC1 and SRC2. In such an embodiment, the third stage SRC3 and the first stage SRC1 are disposed adjacent to each other in the second direction D2, and the third stage SRC3 and the second stage SRC2 are disposed adjacent to each other in the second direction D2.

Each pixel column disposed on the display panel 110 may include i+1 driving pixels, e.g., first to (i+1)-th driving pixels DP1 to DPi+1. Each of the driving pixels DP1 to DPi+1 may include three pixels, e.g., a first pixel P1, a second pixel P2 and a third pixel P3, sequentially arranged in the first direction D1 and in a one-to-one correspondence with the red, green and blue color pixels Cr, Cg, and Cb.

In an exemplary embodiment, as shown in FIG. 2, the first stage SRC1 is electrically connected to the first pixel P 1, the second stage SRC2 is electrically connected to the second pixel P2, and the third stage SRC3 is electrically connected to the third pixel P3, but the connection relation between the stage and the pixel should not be limited thereto. In an alternative exemplary embodiment, the third stage SRC3 may be electrically connected to the first pixel P1, and the first and second stages SRC1 and SRC2 may be electrically connected to the second and third pixels P2 and P3, respectively. In another alternative exemplary embodiment, the third stage SRC3 may be electrically connected to the second pixel P2 and the first and second stages SRC1 and SRC2 may be electrically connected to the first and third pixels P1 and P3, respectively.

In an exemplary embodiment, where the position relation of the first to third stages SRC1, SRC2, and SRC3 disposed in the first driving area DA1 has the above-mentioned structure, the stages disposed in the other driving areas have the same position relation as the stages in the first driving area DA1. In such an embodiment, the connection relation between the first to third stages SRC1, SRC2 and SRC3 and the first to third pixels P1, P2 and P3 may be substantially the same as the stages disposed in the other driving areas.

In an exemplary embodiment, as shown in FIG. 3, the third and first stages SRC3 and SRC1 may be disposed adjacent to each other in the second direction D2 within the black matrix area BA when viewed in a cross-sectional view.

Figure 4:
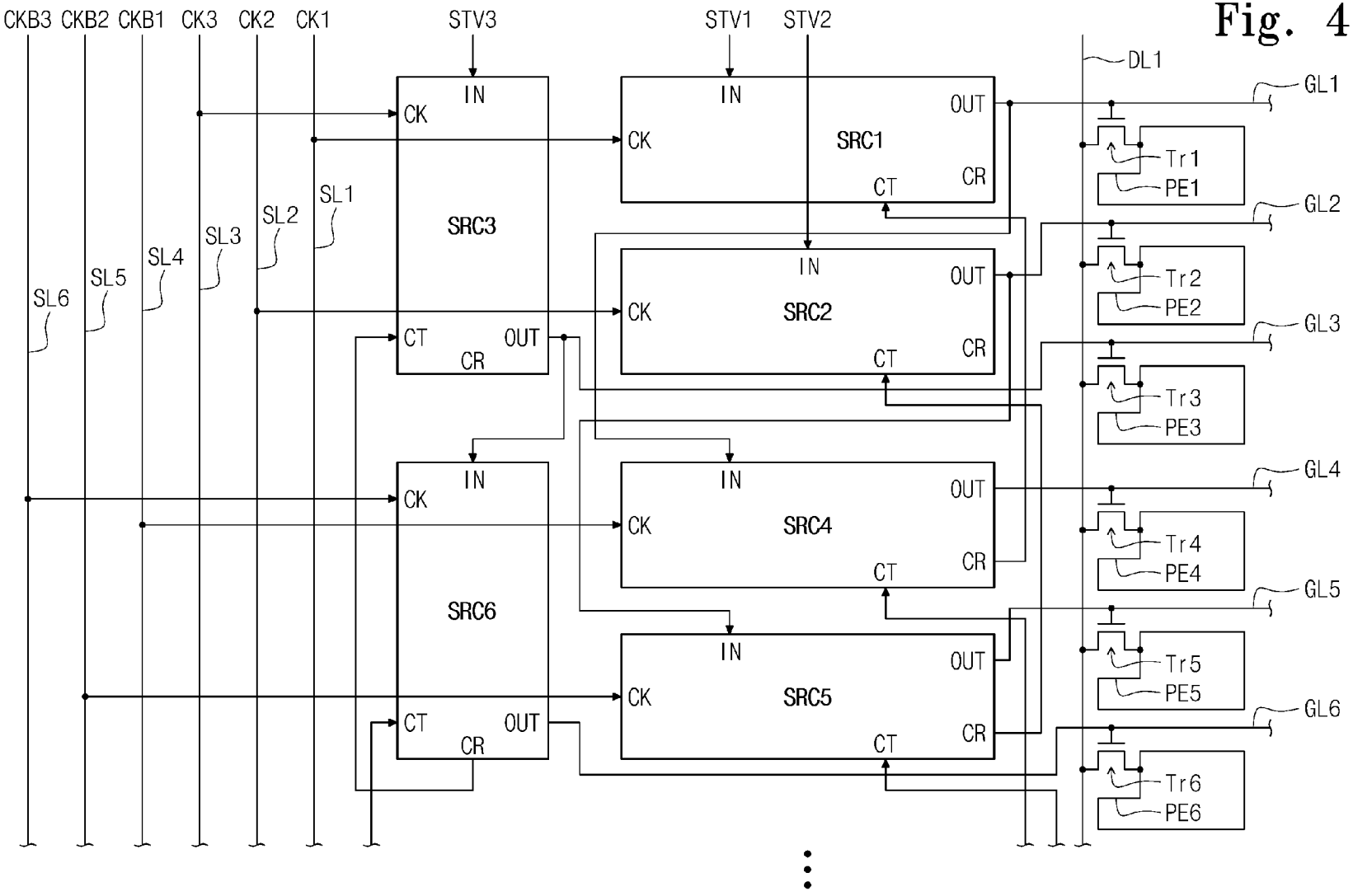
FIG. 4 is a block diagram showing a connection relation between stages in first and second driving areas shown in FIG. 2.

FIG. 4 is a block diagram showing a connection relation between stages in first and second driving areas shown in FIG. 2.

Referring to FIG. 4, the first to third stages SRC1 to SRC3 are disposed in the first driving area DA1, and the fourth to sixth stages SRC4 to SRC6 are disposed in the second driving area DA2. The first stage SRC1 is connected to a first gate line GL1, the second stage SRC2 is connected to a second gate line GL2, and the third stage SRC3 is connected to a third gate line GL3.

The first gate line GL1 is connected to the first pixel P1 of the first driving pixel DP1, the second gate line GL2 is connected to the second pixel P2 of the first driving pixel DP1, and the third gate line GL3 is connected to the third pixel P3 of the first driving pixel DP1.

In an exemplary embodiment, the first to third pixels P1 to P3 have the same structure and function, and the first pixel P1 will hereinafter be described in detail for convenience of description. The first pixel P1 includes a first thin film transistor Tr1 and a first pixel electrode PE1. The first thin film transistor Tr1 includes a gate electrode connected to the first gate line GL1, a source electrode connected to a first data line DL1 of the data lines, and a drain electrode connected to the first pixel electrode PE1. In such an embodiment, the first thin film transistor Tr1 is turned on in response to a first gate signal G1 applied to the first gate line GL1 and applies the data voltage transmitted through the first data line DL1 to the first pixel electrode PE1.

In an exemplary embodiment, each of the first to sixth stages SRC1 to SRC6 includes an input terminal IN that receives an input signal, a control terminal CT that receives a control signal, an output terminal OUT that outputs the gate signal, a carry terminal CR that outputs a carry signal, and a clock terminal CK that receives a clock.

The input terminal IN of the first stage SRC1 receives a first start signal STV1 as the input signal, the input terminal IN of the second stage SRC2 receives a second start signal STV2 as the input signal, and the input terminal IN of the third stage SRC3 receives a third start signal STV3 as the input signal. A phase difference between the first, second and third start signals STV1, STV2 and STV3 may be about H/3. Here, 1H notes one horizontal scanning period.

The output terminal OUT of the first stage SRC1 is connected to the first gate line GL1 and the input terminal IN of the fourth stage SRC4. The carry terminal CR of the fourth stage SRC4 is connected to the control terminal CT of the first stage SRC1. In such an embodiment, the clock terminal CK of the first stage SRC1 receives the first clock CK1.

The output terminal OUT of the second stage SRC2 is connected to the second gate line GL2 and the input terminal IN of the fifth stage SRC5. The carry terminal CR of the fifth stage SRC5 is connected to the control terminal CT of the second stage SRC2. The clock terminal CK of the second stage SRC2 receives the second clock CK2. In an exemplary embodiment, the second clock CK2 may have a phase difference of about H/3 with respect to the first clock CK1.

The output terminal OUT of the third stage SRC3 is connected to the third gate line GL3 and the input terminal IN of the sixth stage SRC6. The carry terminal CR of the sixth stage SRC6 is connected to the control terminal CT of the third stage SRC3. The clock terminal CK of the third stage SRC3 receives the third clock CK3. The third clock CK3 may have a phase difference of about H/3 with respect to the second clock CK2.

The clock terminal CK of the fourth stage SRC4, the clock terminal CK of the fifth stage SRC5 and the clock terminal CK of the sixth stage SRC6 receives the first clock bar CKB1, the second clock bar CKB2 and the third clock bar CKB3, respectively. The first clock bar CKB1 has a phase opposite to the phase of the first clock CK1, the second clock bar CKB2 has a phase opposite to the phase of the second clock CK2, and the third clock bar CKB3 has a phase opposite to the phase of the third clock CK3.

In an exemplary embodiment, the gate driver 120 further includes first, second and third clock lines SL1, SL2 and SL3 to respectively apply the first, second and third clocks CK1, CK2 and CK3 to the first, second and third stages SRC1, SRC2 and SRC3. In such an embodiment, the gate driver 120 further includes first, second and third clock bar lines SL4, SL5 and SL6 to respectively apply the first, second and third clock bars CKB1, CKB2 and CKB3 to the fourth, fifth and sixth stages SRC4, SRC5 and SRC6.

In an exemplary embodiment, the first and second stages SRC1 and SRC2 are positioned at a right side with reference to the third stage SRC3, and the first to third clock lines SL1 to SL3 are positioned at a left side with reference to the third stage SRC3. The fourth and fifth stages SRC4 and SRC5 are positioned at a right side with reference to the sixth stage SRC6, and the first to third clock bar lines SL4 to SL6 are positioned at a left side with reference to the sixth stage SRC6. The third and sixth stages SRC3 and SRC6 are arranged in the first direction D1, and the first, second, fourth and fifth stages SRC1, SRC2, SRC4 and SRC5 are sequentially arranged in the first direction D1.

In an exemplary embodiment, the third and sixth stages SRC3 and SRC6 electrically connected to each other are arranged adjacent to each other in the first direction D1, lines may be effectively disposed in the second driving area DA2 to electrically connect the third and sixth stages SRC3 and SRC6. In such an embodiment, lines that electrically connect the stages with each other may be efficiently disposed in the second driving area DA2 such that the area utilization efficiency of gate driver 120 is substantially improved when the gate driver 120 is integrated on the display panel 110.

Although not shown in FIG. 4, each of the first to sixth stages SRC1 to SRC6 may further include a voltage input terminal applied with a gate off voltage or a ground voltage and a reset terminal applied with a reset signal.

Figure 5A:
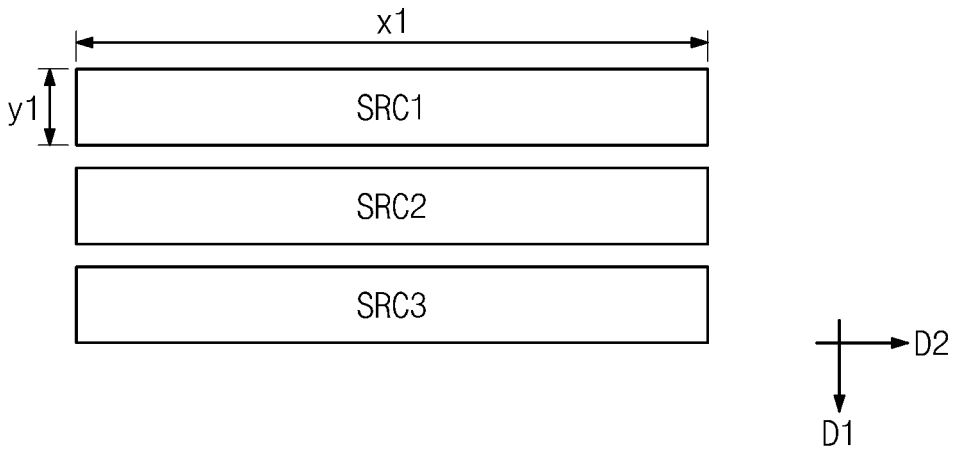
FIG. 5A is a plan view showing first, second and third stages sequentially arranged in a first direction.
Figure 5B:
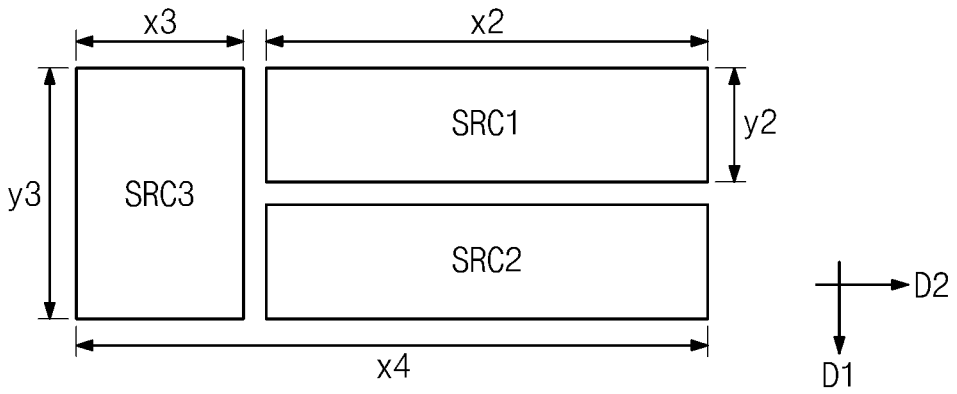
FIG. 5B is a plan view showing first, second and third stages shown in FIG 2.

FIG. 5A is a plan view showing first, second and third stages sequentially arranged in a first direction, and FIG. 5B is a plan view showing first, second and third stages shown in FIG. 2.

Referring to FIG. 5A, each of the first to third stages SRC1 to SRC3 has a rectangular shape elongated in the second direction D2, a length in which is greater than a length in the first direction D1. Hereinafter, a y-axis length in the first direction D1 of each of the first to third stages SRC1 to SRC3 is also referred to as a first y-pitch yl, and an x-axis length in the second direction D2 of each of the first to third stages SRC1 to SRC3 is also referred to as a first x-pitch x1.

In an exemplary embodiment, the first x-pitch x1 may be increased as the first y-pitch y1 of each of the first to third stages SRC1 to SRC3 decreases to integrate all elements of each of the first to third stages SRC1 to SRC3 in the black matrix area BA of the display panel 110. In such an embodiment, when the first y-pitch yl decreases, that is, when the first x-pitch x1 increases, the area utilization efficiency decreases such that a width of the black matrix area BA increases.

Referring to FIG. 5B, In an exemplary embodiment, the first y-pitch y1 of each of the first and second stages SRC1 and SRC2 increases to a second y-pitch y2 having the y-axis length one and a half times greater than the first y-pitch y1, the x-axis length of each of the first and second stages SRC1 and SRC2 decreases to a second x-axis pitch x2. In such an embodiment, since the area utilization efficiency is substantially improved when the y-axis length increases to the second y-pitch y2 from the first y-pitch y1, the second x-pitch x2 decreases to a length less than ⅔ of the first x-pitch x1.

In an exemplary embodiment, the y-axis length of the third stage SRC3 increases to a third y-pitch y3 having the y-axis length three times greater than the first y-pitch y1, the x-axis length of the third stage SRC3 decreases to a third x-axis pitch x3. In such an embodiment, since the area utilization efficiency is substantially improved when the y-axis length increases to the third y-pitch y3 from the first y-pitch y1, the third x-pitch x3 decreases to a length less than ⅓ of the first x-pitch x1. In such an embodiment, the third x-pitch x3 is greater than the first y-pitch y1.

In an exemplary embodiment, as described above, when the y-axis length of each stage increases, the area utilization efficiency is substantially improved when each stage is disposed inside the black matrix area. In such an embodiment, the x-axis length of the first to third stages SRC1 to SRC3 may be a fourth x-pitch x4 less than the first x-pitch x1 such that the width of the black matrix area BA may be reduced from the first x-pitch x1 to the fourth x-pitch x4 when the first to third stages SRC1 to SRC3 are provided therein. In such an embodiment, at least two stages of the first to third stages SRC1 to SRC3 are disposed adjacent to each other in the second direction D2, and a display apparatus having a narrow bezel may be thereby realized.

Figure 6:
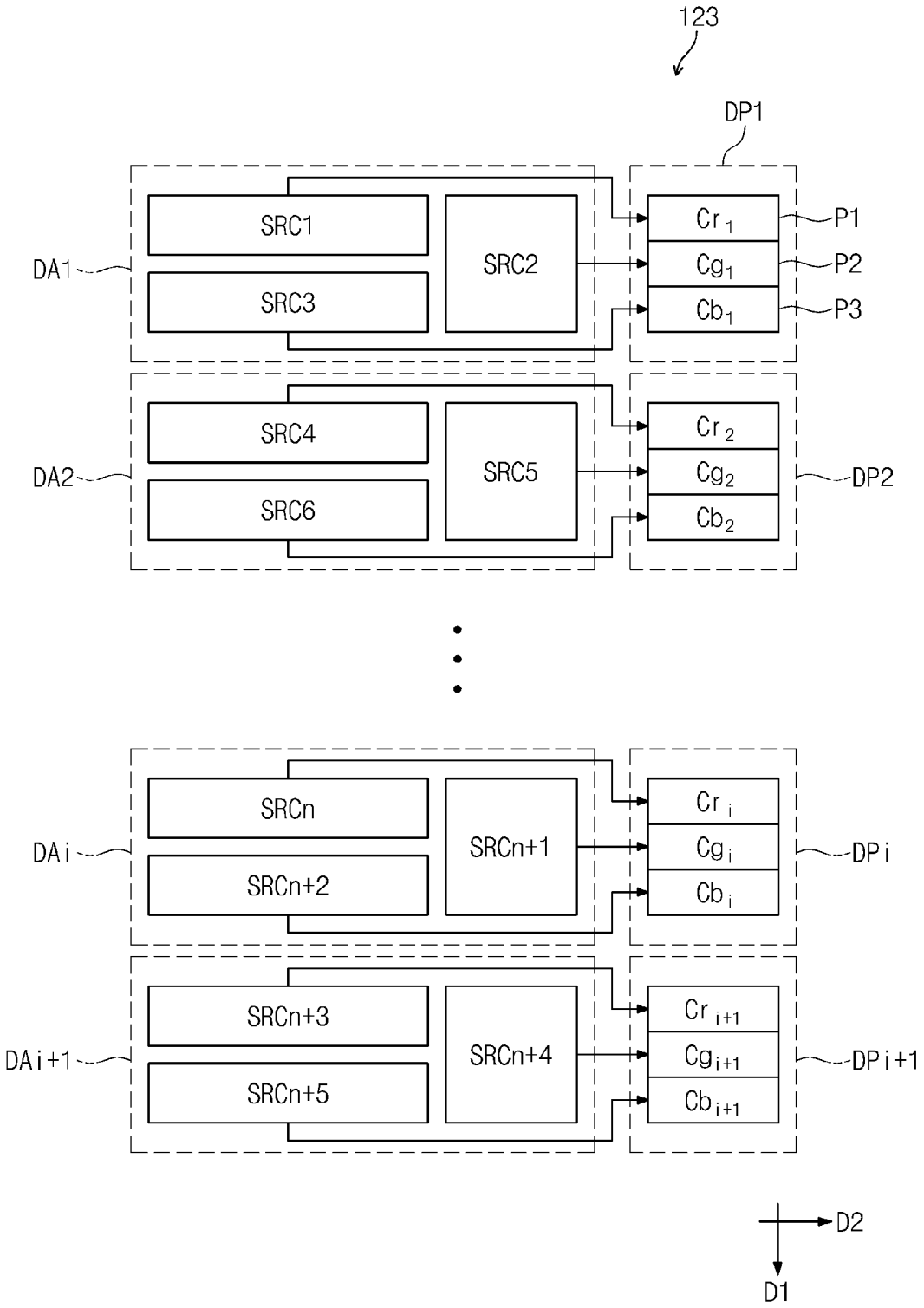
FIG. 6 is a block diagram showing an alternative exemplary embodiment of a gate driver according to the invention.

FIG. 6 is a block diagram showing an alternative exemplary embodiment of a gate driver according to the invention.

Referring to FIG. 6, a gate driver 123 is divided into i+1 driving areas, e.g., the first to (i+1)-th driving area DA1 to DAi+1 ("i" is an odd-number greater than or equal to 1). In such an embodiment, the first driving area DA1 of the i+1 driving areas DA1 to DAi+1 includes a first stage SRC1, a second stage SRC2 and a third stage SRC3, and the second driving area DA2 includes a fourth stage SRC4, a fifth stage SRC5 and a sixth stage SRC6.

In an exemplary embodiment, as shown in FIG. 6, the first and third stages SRC1 and SRC3 are arranged adjacent to each other in the first direction D1, and the second stage SRC2 is positioned at a right side of the first and third stages SRC1 and SRC3. In such an embodiment, the second stage SRC2 and the first stage SRC1 are arranged adjacent to each other in the second direction D2, and the second stage SRC2 and the third stage SRC3 are arranged adjacent to each other in the second direction D2.

In an exemplary embodiment, the fourth and sixth stages SRC4 and SRC6 are arranged adjacent to each other in the first direction D1, and the fifth stage SRC5 is positioned at a right side of the fourth and sixth stages SRC4 and SRC6. In such an embodiment, the fifth stage SRC5 and the fourth stage SRC4 are arranged adjacent to each other in the second direction D2, and the fourth stage SRC4 and the sixth stage SRC6 are arranged adjacent to each other in the second direction D2.

In an exemplary embodiment, since the second and fifth stages SRC2 and SRC5 electrically connected to each other are arranged adjacent to each other in the first direction D1, lines may be effectively disposed in the second driving area DA2 to electrically connect the second and fifth stages SRC2 and SRC5. In such an embodiment, lines that electrically connect the stages with each other may be efficiently disposed in the second driving area DA2 such that the area utilization efficiency of the gate driver 123 is substantially improved when the gate driver 123 is integrated on the display panel 110.

In an exemplary embodiment, each of pixel columns disposed on the display panel 110 may include i+1 driving pixels DP1 to DPi+1. Each of the driving pixels DP1 to DPi+1 may include a first pixel P1, a second pixel P2 and a third pixel P3, which is in one-to-one correspondence with red, green and blue color pixels Cr, Cg and Cb and sequentially arranged in the first direction D1.

As shown in FIG. 6, the first stage SRC1 is electrically connected to the first pixel P1, the second stage SRC2 is electrically connected to the second pixel P2, and the third stage SRC3 is electrically connected to the third pixel P3.

Figure 7:
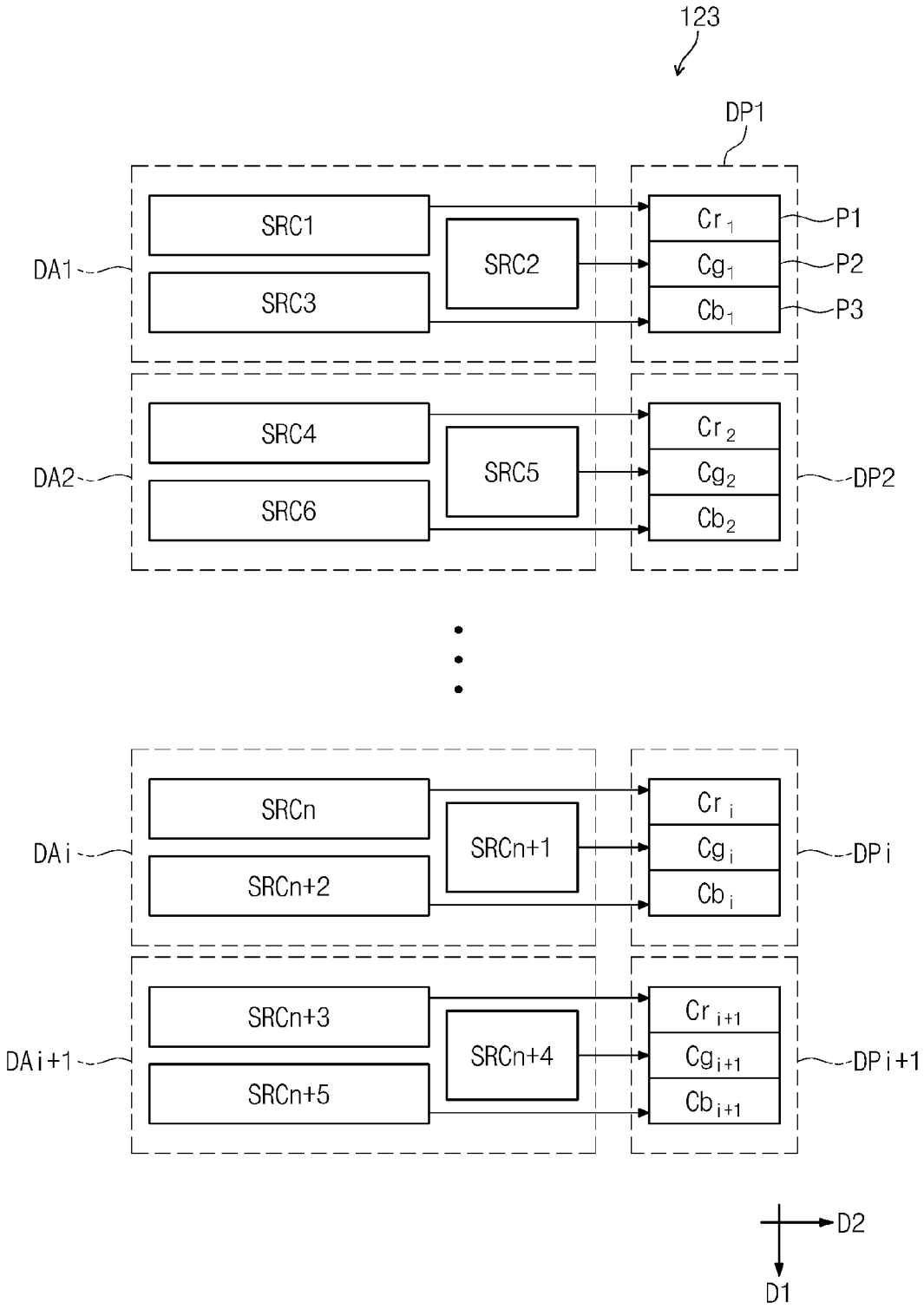
FIG. 7 is a block diagram showing another alternative exemplary embodiment of a gate driver according to the invention.

FIG. 7 is a block diagram showing another alternative exemplary embodiment of a gate driver according to the invention. In FIG. 7, the same reference characters are used to denote the same or like elements shown in FIG. 6, and any repetitive detailed description thereof will now be omitted.

Referring to FIG. 7, in an exemplary embodiment of the gate driver 123, the y-axis length of the second stage SRC2 may be less than a sum of the y-axis length of the first stage SRC1 and the y-axis length of the third stage SRC3. In such an embodiment, where the y-axis length of the second stage SRC2 is less than the sum of the y-axis length of the first stage SRC1 and the y-axis length of the third stage SRC3, a connection line used to connect the first stage SRC1 and the first pixel P1 may be disposed at an upper portion of the second stage SRC2, and a connection line used to connect the third stage SRC3 and the third pixel P3 may be disposed at a lower portion of the second stage SRC2. In such an embodiment, the length of the connection line may decrease such that signals transmitted through the connection lines may be effectively prevented from being delayed.

Figure 8:
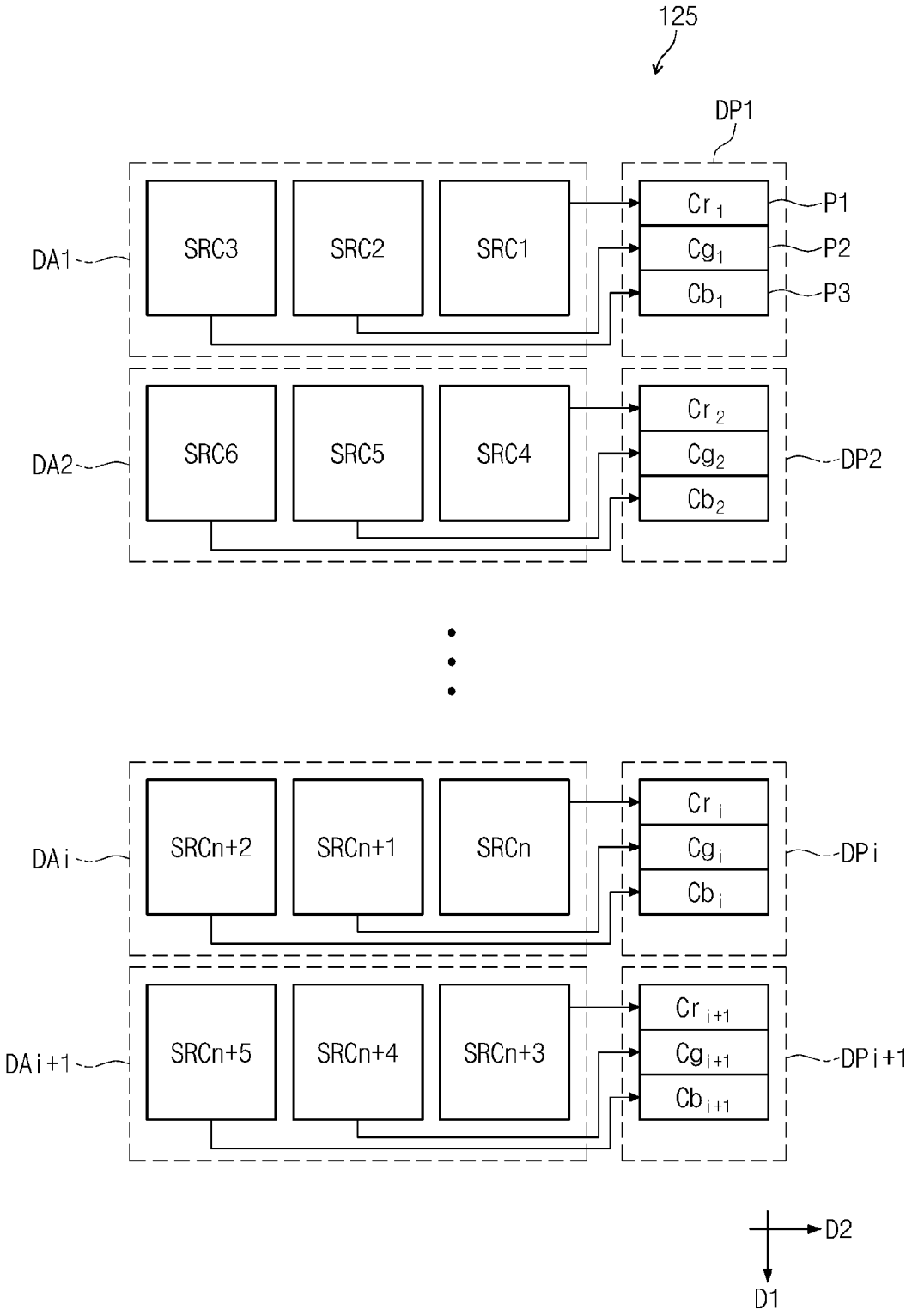
FIG. 8 is a block diagram showing another alternative exemplary embodiment of a gate driver according to the invention.

FIG. 8 is a block diagram showing another alternative exemplary embodiment of a gate driver according to the invention.

Referring to FIG. 8, a gate driver 125 includes a plurality of stages, e.g., first to (n+5)-th stages SRC1 to SRCn+5. In an exemplary embodiment, the stages SRC1 to SRCn+5 are disposed on the display panel 110 and respectively connected to the pixels to sequentially apply the gate signals G1 to Gi+1.

The gate driver 125 is divided into i+1 driving areas, e.g., first to (i+1)-th driving areas DA1 to DAi+1 ("i" is an odd-number greater than or equal to 1). The i+1 driving areas DA1 to DAi+1 may be sequentially arranged in the first direction D1. In an exemplary embodiment, each of the i+1 driving areas DA1 to DAi+1 includes three stages. For the convenience of description, the three stages arranged in the first driving area DA1 of the i+1 driving areas DA1 to DAi+1 are referred to as a first stage SRC1, a second stage SRC2 and a third stage SRC3, and the three stages arranged in the second driving area DA2 are referred to as a fourth stage SRC4, a fifth stage SRC5 and a sixth stage SRC6.

The three stages included in each driving area are arranged in the second direction D2. As shown in FIG. 8, the three stages in the first driving area DA1 are arranged in the order of the third, second and first stages SRC3, SRC2 and SRC1 toward the second direction D2, and the three stages in the second driving area DA2 are arranged in the order of the sixth, fifth and fourth stages SRC6, SRC5 and SRC4 toward the second direction D2.

Each of the pixel columns disposed on the display panel 110 may include i+1 driving pixels, e.g., first to (i+1)-th driving pixels DP1 to DPi+1. Each of the driving pixels DP1 to DPi+1 includes a first pixel P1, a second pixel P2 and a third pixel P3, which are in one-to-one correspondence with the red, green and blue color pixels Cr, Cg, and Cb sequentially arranged in the first direction D1.

In an exemplary embodiment, the position relation of the first to third stages SRC1, SRC2 and SRC3 in the first driving area DA1 has the above-mentioned structure, and the stages disposed in the other driving areas have the same position relation as the first driving area DA1. In such an embodiment, the connection relation between the stages and the pixels in the other driving areas may have the same connection relation between the stages and the pixels as in the first driving area DA1.

Figure 9:
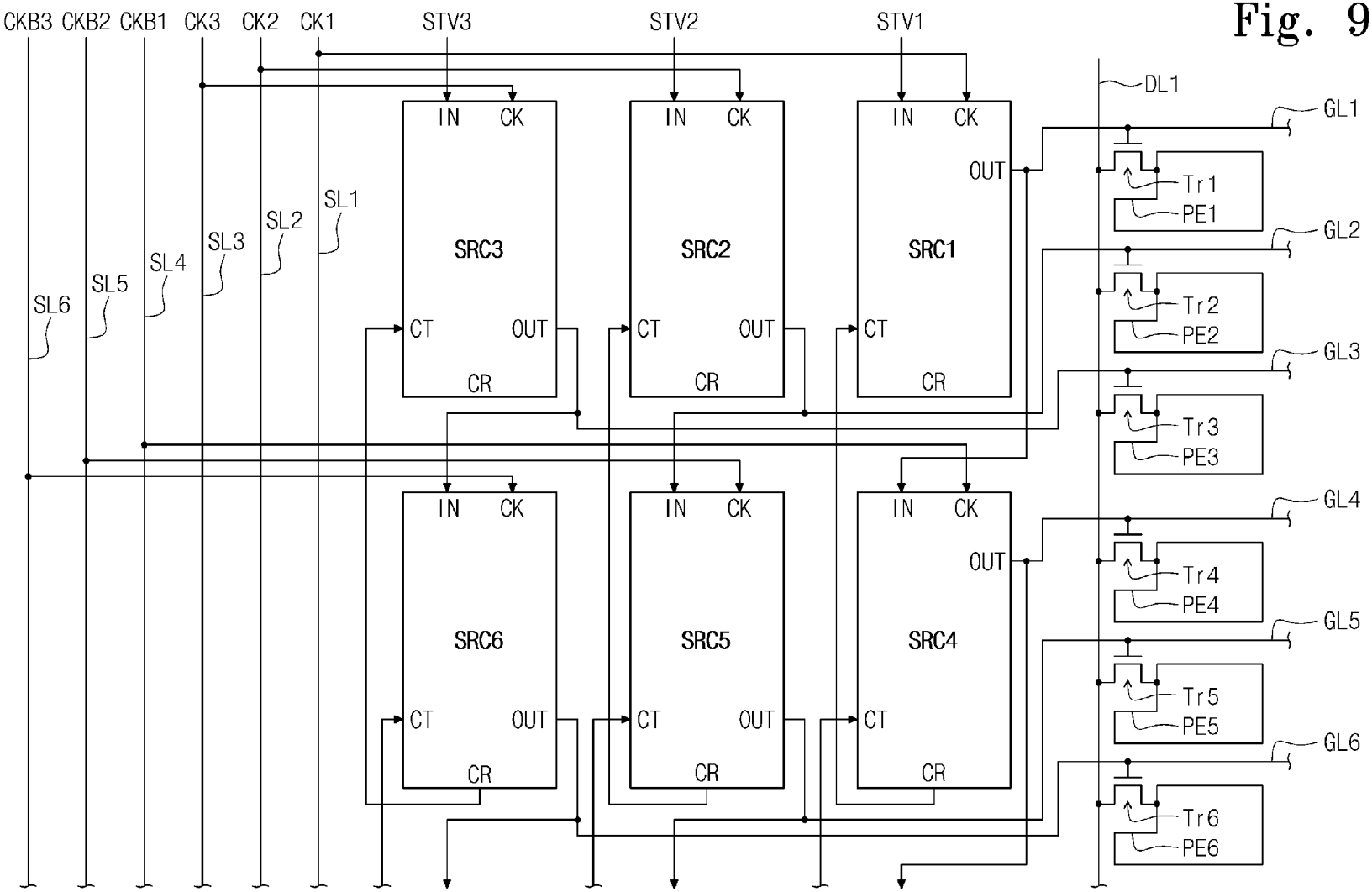
FIG. 9 is a block diagram showing a connection relation between stages in first and second driving areas shown in FIG. 8.

FIG. 9 is a block diagram showing a connection relation between stages in first and second driving areas shown in FIG. 8.

Referring to FIG. 9, the first to third stages SRC1 to SRC3 are disposed in the first driving area DA1, and the fourth to sixth stages SRC4 to SRC6 are disposed in the second driving area DA2. The first stage SRC1 is connected to the first pixel P1 of the first driving pixel DP1, the second stage SRC2 is connected to the second pixel P2 of the first driving pixel DP1, and the third stage SRC3 is connected to the third pixel P3 of the first driving pixel DP1.

Each of the first to sixth stages SRC1 to SRC6 includes an input terminal IN that receives an input signal, a control terminal CT that receives a control signal, an output terminal OUT that outputs the gate signal, a carry terminal CR that outputs a carry signal, and a clock terminal CK that receives a clock.

The input terminal IN of the first stage SRC1 receives a first start signal STV1 as the input signal, the input terminal IN of the second stage SRC2 receives a second start signal STV2 as the input signal, and the input terminal IN of the third stage SRC3 receives a third start signal STV3 as the input signal. The first, second and third start signals STV1, STV2 and STV3 may have a phase difference of about H/3. Here, 1H denotes one horizontal scanning period.

The output terminal OUT of the first stage SRC1 is connected to the input terminal IN of the fourth stage SRC4, and the carry terminal CR of the fourth stage SRC4 is connected to the control terminal CT of the first stage SRC1. In such an embodiment, the clock terminal CK of the first stage SRC1 receives the first clock CK1.

The output terminal OUT of the second stage SRC2 is connected to the input terminal IN of the fifth stage SRC5, and the carry terminal CR of the fifth stage SRC5 is connected to the control terminal CT of the second stage SRC2. In such an embodiment, the clock terminal CK of the second stage SRC2 receives the second clock CK2. In such an embodiment, the second clock CK2 may have the phase difference of about H/3 with respect to the first clock CK1.

The output terminal OUT of the third stage SRC3 is connected to the input terminal IN of the sixth stage SRC6, and the carry terminal CR of the sixth stage SRC6 is connected to the control terminal CT of the third stage SRC3. In such an embodiment, the clock terminal CK of the third stage SRC3 receives the third clock CK3. The third clock CK3 may have the phase difference of about H/3 with respect to the second clock CK2.

The clock terminal CK of the fourth stage SRC4, the clock terminal CK of the fifth stage SRC5 and the clock terminal CK of the sixth stage SRC6 are applied with the first clock bar CKB1, the second clock bar CKB2 and the third clock bar CKB3, respectively. The first clock bar CKB1 has a phase opposite to the phase of the first clock CK1, the second clock bar CKB2 has a phase opposite to the phase of the second clock CK2, and the third clock bar CKB3 has a phase opposite to the phase of the third clock CK3.

The gate driver 125 further includes first, second and third clock lines SL1, SL2 and SL3 to apply the first, second and third clocks CK1, CK2 and CK3 to the first, second and third stages SRC1, SRC2 and SRC3, respectively. In such an embodiment, the gate driver 120 further includes first, second and third clock bar lines SL4, SL5 and SL6 to apply the first, second, and third clock bars CKB1, CKB2 and CKB3 to the fourth, fifth and sixth stages SRC4, SRC5 and SRC6, respectively.

In an exemplary embodiment, the first, second and third stages SRC1, SRC2, and SRC3 are arranged in the second direction D2, and the fourth, fifth and sixth stages SRC4, SRC5 and SRC6 are arranged in the second direction D2.

In such an embodiment, the first and fourth stages SRC1 and SRC4 electrically connected to each other may be arranged adjacent to each other in the first direction D1, the second and fifth stages SRC2 and SRC5 electrically connected to each other may be arranged adjacent to each other in the first direction D1, and the third and sixth stages SRC3 and SRC6 electrically connected to each other may be arranged adjacent to each other in the first direction D1.

In an exemplary embodiment, the stages in a driving area are disposed adjacent to each other, and lines that electrically connect the stages with each other may be efficiently disposed in a substantially small area of the driving area such that the area utilization efficiency of gate driver 125 may be substantially improved when the gate driver 125 is integrated on the display panel 110.

Figure 10:
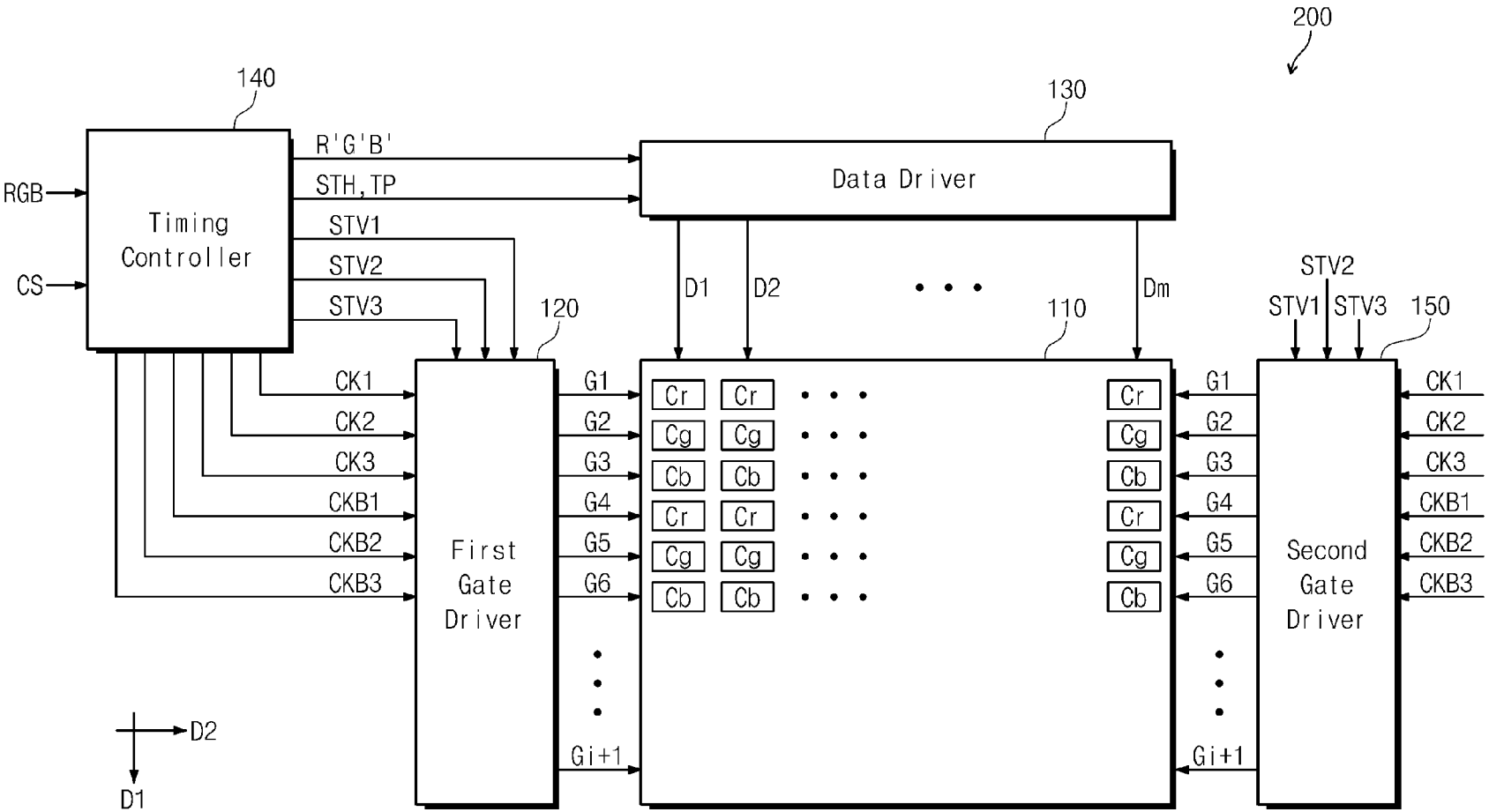
FIG. 10 is a block diagram showing an alternative exemplary embodiment of a display apparatus according to the invention.

FIG. 10 is a block diagram showing an alternative exemplary embodiment of a display apparatus according to the invention. In FIG. 10, the same reference characters denote the same or like elements in FIG. 1, and any repetitive detailed descriptions thereof will be omitted.

Referring to FIG. 10, a display apparatus 200 includes a display panel 110, a first gate driver 120, a data driver 130, a timing controller 140 and a second gate driver 150.

The display panel 110 includes a plurality of pixel columns. Each of the pixel columns includes a plurality of pixels arranged in a column direction (hereinafter, referred to as a first direction D0. Each of the pixels may be connected to the first and second drivers 120 and 150.

In an exemplary embodiment, the timing controller 140 applies gate control signals, such as vertical start signals STV1, STV2 and STV3, vertical clock signals CK1, CK2 and CK3, and vertical clock bar signals CKB1, CKB2 and CKB3, for example, to the first and second drivers 120 and 150. In such an embodiment, the first and second gate drivers 120 and 150 are substantially simultaneously driven to sequentially apply the gate signals G1 to Gn to the pixels.

Although not shown in FIG. 10, the second gate driver 150 may have the same structure as the structure of the gate driver 120 shown in FIG. 2 or the gate driver 125 shown in FIG. 8. Accordingly, any repetitive detailed descriptions of the second gate driver 150 will be omitted.

In an exemplary embodiment, as described above, at least two stages of the three stages disposed in each driving area DA1 to DAi+1 of the first and second drivers 120 and 150 are disposed adjacent to each other in the second direction D2. Thus, when the first and second drivers 120 and 150 are integrated in the black matrix area BA (shown in FIG. 3) of the display panel 110, the area utilization efficiency of the first and second gate drivers in the display panel 110 may be substantially improved. In such an embodiment, the width of the black matrix area BA may be substantially reduced such that the display apparatus having a narrow bezel may be effectively realized.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a display panel including a plurality of pixel columns to display an image, wherein each of the pixel columns includes a plurality of pixels arranged in a first direction and sequentially turned-on in the first direction, the plurality of pixel columns being arranged along a second direction corresponding to a row direction;

a gate driver disposed on the display panel and including a plurality of stages connected to the pixels to sequentially apply a gate signal to the pixels, wherein at least two stages of the stages are disposed adjacent to each other in a same row extending in the second direction different from the first direction; and a data driver which applies a data voltage to the pixels, wherein first and second stages of the stages are disposed adjacent to each other in the first direction, and a third stage of the stages is disposed adjacent to the first and second stages in the second direction.

2. The display apparatus of claim 1, wherein the gate driver is divided into a plurality of driving areas arranged in the first direction, the first, second and third stages of the stages are disposed in an i-th driving area of the driving areas, at least two stages of the first, second and third stages are disposed adjacent to each other in the second direction, and i is a natural number.

3. The display apparatus of claim 2, wherein the display panel further comprises red, green and blue color pixels, and the pixels comprise first, second and third pixels corresponding to the red, green and blue color pixels, respectively, and connected to the first, second and third stages, respectively.

4. The display apparatus of claim 2, wherein the second direction is substantially perpendicular to the first direction.

5. The display apparatus of claim 2, wherein the gate driver further comprises first, second and third clock lines which apply first, second and third clocks to the first, second and third stages, respectively.

6. The display apparatus of claim 5, wherein fourth, fifth and sixth stages are disposed in an (i+1)-th driving area of the driving areas, the fourth, fifth and sixth stages are connected to the first, second and third stages, respectively, and each of the first, second, third, fourth, fifth and sixth stages comprises:

an input terminal which receives an input signal;

a control terminal which receives a control signal;

an output terminal which outputs the gate signal; and a carry terminal which outputs a carry signal.

7. The display apparatus of claim 6, wherein the output terminal of the first stage is connected to the input terminal of the fourth stage, the carry terminal of the fourth stage is connected to the control terminal of the first stage, the output terminal of the second stage is connected to the input terminal of the fifth stage, the carry terminal of the fifth stage is connected to the control terminal of the second stage, the output terminal of the third stage is connected to the input terminal of the sixth stage, and the carry terminal of the sixth stage is connected to the control terminal of the third stage.

8. The display apparatus of claim 7, wherein the third and sixth stages are disposed adjacent to each other in the first direction, and the first, second, fourth and fifth stages are arranged in the first direction in an order of the first, second, fourth and fifth stages.

9. The display apparatus of claim 6, wherein the gate driver further comprises fourth, fifth and sixth clock lines which apply first, second and third clock bars to the fourth, fifth and sixth stages, respectively, the first clock bar has a phase opposite to a phase of the first clock, the second clock bar has a phase opposite to a phase of the second clock, and the third clock bar has a phase opposite to a phase of the third clock.

10. A method of manufacturing a display apparatus, the method comprising:

providing a plurality of pixels columns including a plurality of pixels arranged in a first direction on a display panel of the display apparatus, the plurality of pixel columns being arranged along a second direction corresponding to a row direction; and providing a gate driver including a plurality of stages on the display panel such that the stages are connected to the pixels and at least two stages of the stages are disposed adjacent to each other in a same row extending in the second direction different from the first direction, wherein first and second stages of the stages are disposed adjacent to each other in the first direction, and a third stage of the stages is disposed adjacent to the first and second stages in the second direction.

11. The method of claim 10, wherein the gate driver is divided into a plurality of driving areas arranged in the first direction, three stages are disposed in each of the driving areas, and at least two stages of the three stages are disposed adjacent to each other in the second direction.

12. The method of claim 11, wherein the first and second stages of the three stages are disposed adjacent to each other in the first direction, and the third stage of the three stages is disposed adjacent to the first and second stages in the second direction.

* * * * *